United States Patent [19]

Kitamura

[11] Patent Number: 4,519,369

[45] Date of Patent: May 28, 1985

[54] AIR SUCTION DEVICE FOR DIESEL ENGINE

[75] Inventor: Kazuhiko Kitamura, Nagoya, Japan

[73] Assignee: Aisin Keiki Kabushiki Kaisha, Japan

[21] Appl. No.: 452,828

[22] Filed: Dec. 23, 1982

[30] Foreign Application Priority Data

Dec. 26, 1981 [JP] Japan ..... 56-214836

[51] Int. Cl.[3] ..... F02D 9/08

[52] U.S. Cl. ..... 123/337; 123/403

[58] Field of Search ..... 123/337, 357, 376, 378, 123/389, 399, 400, 403, 432; 261/42, 63, 65

[56] References Cited

U.S. PATENT DOCUMENTS

| | | | |
|---|---|---|---|
| 2,062,260 | 11/1936 | Weber | 261/65 |
| 3,620,195 | 11/1971 | Lamm | 123/337 |
| 3,661,131 | 5/1972 | Croft | 123/339 |
| 4,158,352 | 6/1979 | Blatter | 123/337 |
| 4,308,837 | 1/1982 | Nohira et al. | 123/337 |
| 4,354,465 | 10/1982 | Takeuchi et al. | 123/389 |
| 4,426,972 | 1/1984 | Kimura et al. | 123/376 |

*Primary Examiner*—Parshotam S. Lall
*Assistant Examiner*—W. R. Wolfe
*Attorney, Agent, or Firm*—Finnegan, Henderson, Farabow, Garrett & Dunner

[57] ABSTRACT

An air suction device for a diesel engine having a throttle valve disposed within an air suction passage wherein the throttle valve has an opening through which air may pass even when the throttle valve is in a closed position and wherein a mechanism is positioned adjacent that hole to selectively control the amount of air passing through that hole when the throttle valve is in a closed position.

4 Claims, 2 Drawing Figures

AIR SUCTION DEVICE FOR DIESEL ENGINE

BACKGROUND OF THE INVENTION

I. Field of Invention

The present invention relates to devices which control the amount of air available to a diesel engine.

II. Description of the Prior Art

It is well known that the speed of a diesel engine, that is the number of revolutions per minute, can be controlled by adjusting the amount of fuel injected into that engine and adjusting the timing of that fuel injection. However, if some control over the amount of air entering into the air suction passage of such a diesel engine is not maintained, the diesel engine is subject to violent vibrations and objectionable noises due to the existence of an excess amount of sucked air. Such vibration and noise is especially prevalent when a diesel engine is idling or operating under low load conditions. Such vibrations and noise are uncomfortable to the driver and passengers.

Prior art devices are known which employ a throttle valve to control the volume of air flow in an air suction passage of an engine. Such prior art throttle valves operate so as to restrict the flow of air through the air suction passage when the engine is in a low load condition. Throttle valve arrangements are known which employ a passage external to the air suction passage to by-pass the throttle valve. The amount of air flow through such a external passage is controlled by an air flow controlling means. However, the construction of an effective external passage has in the past been complex and, therefore, expensive.

It is, accordingly, an object of the present invention to provide a new and improved air suction device for a diesel engine which reduces vibration and noise due to excessive amounts of air flowing through the air suction passage of the engine.

It is another object of the present invention to provide a new and novel air suction device for a diesel engine which selectively restricts air flow through an air suction passage but yet is simple and inexpensive to construct.

Additional objects and advantages of the invention will be set forth in part in the description which follows, and in part will be obvious from the description or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, an air suction device for a diesel engine having a throttle valve disposed within an air suction passage is provided which comprises: (a) an opening in the throttle valve through which air may pass even when the throttle valve is in a closed position; and (b) an air flow controlling means positioned within the air suction passage adjacent the throttle valve for selectively controlling the flow of air which may pass through the opening in the throttle valve. More specifically, the air flow controlling means includes: (i) an air flow passage which is located within the air suction passage and which is aligned to receive air through the opening of the throttle valve when the throttle valve is in a closed position, and (ii) valve means for selectively restricting the flow of air through the air flow passage in response to a control signal.

Preferably the valve means includes a solenoid and a valve member whose position is determined by operation of the solenoid. It is further preferable that the air flow controlling means includes means for preventing any air from flowing around the opening in the throttle valve when the throttle valve is in a closed position except for air which also flows through the air flow passage. It is further preferable that there be provided a control unit for generating the above-mentioned control signal in response to the temperature of the engine, the speed of the engine and the pressure within the air suction passage of the engine.

BRIEF DESCRIPTION OF THE DRAWINGS

Additional objects and advantages of the invention will be more readily apparent from the following detailed description of the preferred embodiment thereof when taken together with the accompanying drawings in which.

DETAILED DESCRIPTION OF THE PREFERRED EMBODIMENT

Reference will now be made in detail to the present preferred embodiment of the invention as illustrated in the accompanying drawings.

Figure 1:
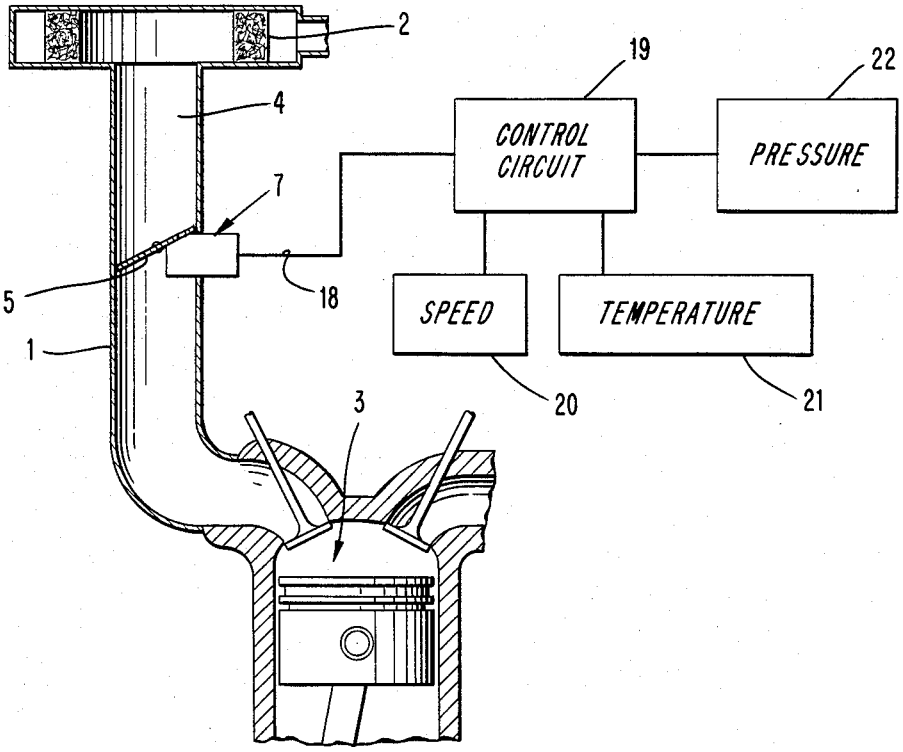
FIG. 1 is a view illustrating a system having an air suction device according to the teachings of the present invention.

In FIG. 1 there are illustrated an air suction pipe 1 of a diesel engine, an air filter 2 positioned adjacent the intake to air suction pipe 1, a portion of a diesel engine 3, and an air suction passage 4 defined by the interior walls of air suction pipe 1. A throttle valve 5 having a butterfly configuration is illustrated as being pivotally positioned within air suction passage 4. An air flow control unit 7 is further illustrated as being positioned within air suction passage 4 adjacent throttle valve 5.

Figure 2:
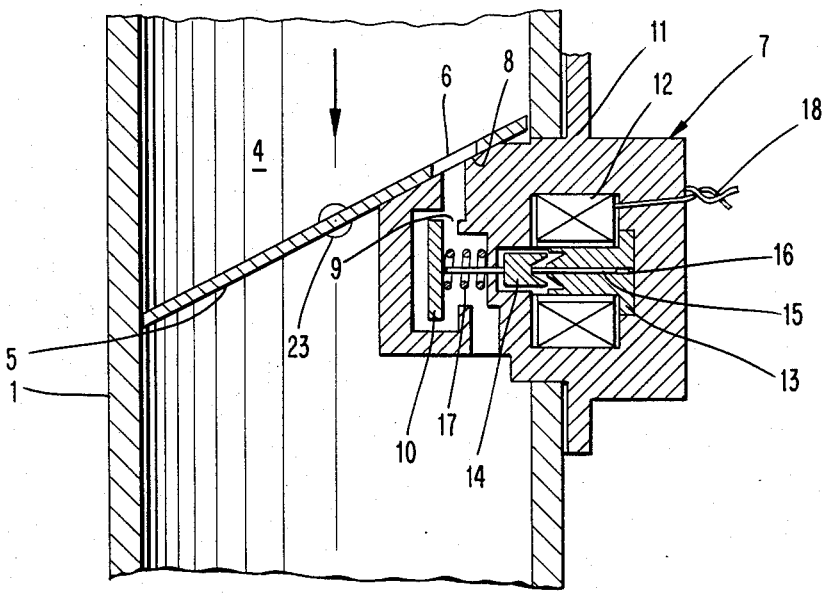
FIG. 2 is an enlarged cross-sectional view of the air suction device of FIG. 1.

As may be better seen from FIG. 2, throttle valve 5 has an opening or hole 6. Hole 6 is positioned in throttle valve 5 to directly correspond with the position of air flow control unit 7 and valve 5 is pivoted about axis 23 to a closed position.

As is further shown in FIG. 2, control unit 7 includes a flat surface section 8, an air flow passage 9, a valve member 10, a solenoid 11, a solenoid coil 12, a stationary core 13, a movable core 14, a shaft 15, a penetrating passage 16, a spring 17, and electric wires 18. Air flow passage 9 is located within air suction passage 4 and is aligned to receive air through opening 6 of throttle valve 5, when throttle valve 5 is in a closed position. When in a closed position, the surface of throttle valve 5 adjacent to hole 6 lies in direct contact with flat surface section 8 to prevent any air from flowing through opening 6 when throttle valve 5 is in a closed position except for air which also flows through air flow passage 9. Throttle valve 5 may be opened and closed by operation of a conventional diaphragm and link mechanism (not shown) or the like.

Valve member 10 of air flow control unit 7 selectively restricts the flow of air through air flow passage 9. The positioning of valve member 10 is dictated by operation of electric solenoid 11. When in a fully closed position, valve member 10 fully closes off air flow passage 9. The location of valve member 10 between a fully closed position and a fully opened position selectively restricts the amount of air which may pass through air flow passage 9.

Solenoid 11 includes cylindrical solenoid coil 12. Stationary core 13 is diposed within the solenoid coil 12. Moveable core 14 is connected to valve member 10 by shaft 15. Shaft 15 is axially slidable within penetrating passage 16 provided in stationary core 13. Spring 17 biases valve member 10 in a normally open direction against a closing force selectively generated by moving coil 14 of solenoid 11. Accordingly, valve member 10 functions to control the amount of air flow under the balance of the biasing force of spring 17 and the closing force of solenoid 11.

A control circuit 19 shown in FIG. 1 receives input signals from engine speed or revolution sensor 20, engine temperature sensor 21 and air suction passage pressure sensor 22. Control circuit 19 delivers a control signal to solenoid coil 12 through electronic wires 18. It should be noted that control circuit 19 may further receive an input signal in response to the position of throttle valve 5 and/or in response to the position of the accelerator pedal of engine 3.

In operation, when engine 3 is first started and the engine temperature is low, it is desirable to have both throttle valve 5 and air flow control 7 forced into fully opened positions so that, upon starting the engine, a sufficient amount of air is transmitted to the engine. Accordingly, whenever the engine temperature is detected by sensor 21 to be lower than a predetermined value, control circuit 19 operates to locate valve member 10 in a fully opened position. Under this condition the outputs of sensors 20 and 21 have no effect on the location of throttle valve 5 or the location of valve member 10. Upon startup, valve member 5 is also oriented in an open position, preferably through conventional techniques. Accordingly, upon startup, a major portion of the air flow will be sucked through air passageway 4 without any flow resistance from throttle valve 5 and a remaining part of the air flow will be sucked through air flow passage 9.

When the air temperature is higher than a predetermined value and when the engine is under idling conditions, throttle valve 5 is closed by conventional techniques using a throttle switch in association with an accelerator pedal. In this condition, air flow through air suction passage 4 is completely determined by the operation of air flow control unit 7 in response to the amount of vacuum detected by sensor 22 downstream of throttle valve 5. Air flow control unit 7 operates, under these conditions, to maintain a constant vacuum or pressure level downstream of throttle valve 5. More specifically, valve member 10 is urged into an open position to increase the flow of air through air flow passage 9 when vacuum pressure is high within pipe 1 downstream of throttle valve 5. However, valve member 10 is urged into a position to reduce the flow of air in air flow passage 4 when vacuum pressure is measured by sensor 22 to be low downstream of throttle valve 5.

When the engine temperature is higher than a predetermined value and the number of engine revolutions sensed by sensor 20 is higher than predetermined value indicating that the accelerator pedal has been depressed, valve member 10 is maintained in a fully opened position. At the same time, the throttle switch is closed and, in accordance with known technology, this results in a signal being transmitted to the diaphragm and link mechanism of throttle valve 5 to maintain throttle valve 5 in a fully opened condition. Thus, a sufficient amount of air is available to be sucked through air suction passage 4 to maintain the engine under normal running conditions.

Upon deceleration, when the accelerator pedal is released, the throttle switch is opened and this results in a signal which is utilized in a conventional manner to close throttle valve 5. The deceleration condition is also sensed by speed sensor 20 and is transmitted to control circuit 19. Control circuit 19 can thereby judge the degree to which valve member 10 needs to be closed in order to maintain a smooth running condition. In this regard, control circuit 19 may also take into consideration the pressure signal provided by sensor 22 and the temperature signal provided by sensor 21. As the pressure detected by sensor 22 varies, the position of valve member 10 may be controlled by control circuit 19 in order to maintain a constant running condition.

In summary, control circuit 19 continuously receives input signals from sensors 20, 21 and 22 which are used by control circuit 19 to control the position of moveable core 14 and, hence, the position of valve member 10. As valve member 10 is moved to the left as shown in FIG. 2, the minimum effective cross sectional area of air flow passage 9 is increased thereby permitting the amount of air sucked through air flow passage 9 to be increased. Conversely, control circuit 19 may operate to position moveable core 14 in a manner whereby valve member 10 restricts the flow of air permitted through air flow passage 9. Control circuit 19 is programmed in such a manner as to maintain a smooth operation of engine 3 by positioning valve member 10 as a function of pressure, speed and temperature of the engine.

Additional advantages and modifications will readily occur to those skilled in the art. The invention in its broader aspect is, therefore, not limited to the specific details, representative apparatus, and illustrative examples shown and described. Accordingly, departures may be made from such details without departing from the spirit or scope of applicant's general inventive concept.

I claim:

1. An air suction device for a diesel engine having a throttle valve disposed within an air suction passage, said air suction device comprising:

a. an opening in said throttle valve through which air may pass even when said throttle valve is in a closed position; and b. air flow controlling means positioned within said air suction passage adjacent said throttle valve for selectively controlling the flow of air which may pass through said opening in said throttle valve, said air flow controlling means including: (i) an air flow passage which is located within said air suction passage and which is aligned to receive air from said opening of said throttle valve when said throttle valve is in a closed position, and (ii) valve means for selectively restricting the flow of air through said air flow passage in response to a control signal.

2. The device of claim 1 wherein said valve means includes a solenoid and a valve member whose position is determined by operation of said solenoid.

3. The device of claim 1 wherein said air flow controlling means includes means for preventing any air from flowing through said opening of said throttle valve when said throttle valve is in a closed position except for air which also flows through said air flow passage.

4. The device of claim 1 further including a control unit for generating said control signal in response to the temperature of said engine, speed of said engine, and pressure of air within said air flow passage.

* * * * *